US010704240B2

(12) United States Patent
Lin et al.

(10) Patent No.: US 10,704,240 B2
(45) Date of Patent: Jul. 7, 2020

(54) HANGING CONNECTION SLIDING BASE AND RELATED HANGING CONNECTION FRAME

(71) Applicant: FUJIAN XIHE SANITARY WARE TECHNOLOGY CO., LTD., Fujian (CN)

(72) Inventors: Xiaofa Lin, Fujian (CN); Xiaoshan Lin, Fujian (CN); Zhigang Wan, Fujian (CN); Qiqiao Liu, Fujian (CN); Xiaoqing Deng, Fujian (CN)

(73) Assignee: FUJIAN XIHE SANITARY WARE TECHNOLOGY CO., LTD., Fujian (CN)

( * ) Notice: Subject to any disclaimer, the term of this patent is extended or adjusted under 35 U.S.C. 154(b) by 0 days.

(21) Appl. No.: 16/247,579

(22) Filed: Jan. 15, 2019

(65) Prior Publication Data

US 2020/0141099 A1 May 7, 2020

(30) Foreign Application Priority Data

Nov. 1, 2018 (CN) ..... 2018 1 1292783
Nov. 1, 2018 (CN) ..... 2018 2 1788619 U

(51) Int. Cl.

| | |
|---|---|
| ***A47G 29/00*** | (2006.01) |
| ***E03C 1/06*** | (2006.01) |
| *B05B 13/02* | (2006.01) |
| *B05B 13/04* | (2006.01) |

(52) U.S. Cl.
CPC ..... *E03C 1/066* (2013.01); *B05B 13/0278* (2013.01); *B05B 13/041* (2013.01)

(58) Field of Classification Search
CPC ..... E03C 1/066; E03C 1/025; B05B 1/185
See application file for complete search history.

(56) References Cited

U.S. PATENT DOCUMENTS

2007/0245483 A1* 10/2007 Eilmus ..... E03C 1/06 4/567
2008/0121771 A1* 5/2008 Sen ..... E03C 1/06 248/229.11
2019/0345700 A1* 11/2019 Davidson ..... B05B 1/185

* cited by examiner

*Primary Examiner* — Amy J. Sterling
(74) *Attorney, Agent, or Firm* — JCIPRNET

(57) ABSTRACT

Provided is a hanging connection sliding base, including a sliding base body sleeved over a rod body, a first elastic element, a packing block and a lever. The lever is hinged to the sliding base body, and is pulled to drive the packing block to be away from the rod body. The first elastic element is arranged between the packing block and the sliding base body, and the packing block is driven to tightly urge the rod body when the lever is released. A related hanging connection frame is further provided. The hanging connection frame includes the above hanging connection sliding base and a rod body. Two sides of the rod body are provided with sliding grooves for receiving the hanging connection sliding base. By the hanging connection sliding base, a ground clearance of the hanging connection sliding base can be adjusted with a single hand.

9 Claims, 8 Drawing Sheets

HANGING CONNECTION SLIDING BASE AND RELATED HANGING CONNECTION FRAME

CROSS REFERENCE TO RELATED APPLICATIONS

The present application claims priority to Chinese Patent Application No. 201811292783.X filed on Nov. 1, 2018, and Chinese Patent Application No. 201821788619.3 filed on Nov. 1, 2018, the entire contents of which are incorporated herein by reference in their entirety.

TECHNICAL FIELD

The present application relates to the field of shower head lifting rods, and in particular to a hanging connection sliding base and a related hanging connection frame.

BACKGROUND OF THE INVENTION

A hanging connection frame fixed to a wall is mostly used in a shower device for holding articles such as a shower head, a rod body of a hanging connection frame is generally provided with a hanging connection sliding base, and the hanging connection sliding base can move up and down along the rod body to adjust a water outflow height of the shower head, so as to be applicable to people in different heights. However, an existing hanging connection sliding base is fixed to the rod body mostly in a manner of magnet adsorption, a large operation force is required to relieve a magnetic force effect when the hanging connection sliding base needs to be moved, and it is inconvenient to use; in the moving process, abrasion of the rod body is caused easily; furthermore, height adjusting operation of the existing hanging connection sliding base is carried out mostly with double hands, that is, one hand is used for relieving fixation between the hanging connection base and the rod body, the other hand is used for moving the hanging connection sliding base up and down, and the operation is inconvenient in the showering process.

The rod body is fixed to the wall mostly by adopting a fixed base through screws, perforating in the wall is needed due to the fixing manner, and the installing process is not convenient or fast; moreover, after installing, a gap between the rod body and the wall is large, an occupied space is large, and an installing requirement of a modern small habitable room cannot be met.

Further, due to the fact that an existing hanging base is fixedly connected to a sliding base body mostly, consequently, an adjustable direction of the shower head is singular, multi-angle rotating use cannot be achieved, and practicability is low.

SUMMARY OF THE INVENTION

The following is the summary of the subject matter described in detail in the present application. The summary is not intended to limit the protection scope of the claims.

The present application provides a hanging connection sliding base and a related hanging connection frame. A user can operate with one hand to unlock the hanging connection sliding base from a rod body and slide the hanging connection sliding base to a new position on the rod body, the operation process saves labor and is simple, and meanwhile, the unlocking and the sliding can avoid abrasion to the rod body. The hanging connection frame of the present application is convenient and fast to install, low in manufacturing cost and capable of substantially reducing the overall installing space.

An embodiment of the present application relates to a hanging connection sliding base, comprising a sliding base body, sleeved over a rod body, and provided with a first ejecting retaining surface facing the rod body; a packing block, arranged between the first ejecting retaining surface and the rod body, and arranged on the sliding base body in a sliding manner in a direction perpendicular to the rod body; a lever, hinged to the sliding base body, and movably connected with the packing block; and a first elastic element, arranged between the first ejecting retaining surface and the packing block; the packing block is driven to be away from the rod body when the lever is pulled; and the first elastic element drives the packing block to urge against the rod body when the lever is released.

The embodiment of the present application further relates to a hanging connection frame, comprising the foregoing hanging connection sliding base and a rod body, wherein two sides of the rod body are provided with sliding grooves, and the hanging connection sliding base is sleeved in the sliding grooves, so that the hanging connection sliding base slides up and down along the rod body.

DESCRIPTION OF THE EMBODIMENTS

The technical solutions in the embodiments of the present application are described with the accompanying drawings in the embodiments of the present application.

Embodiment I

Please refer to FIG. 1 to FIG. 6 in the present embodiment.

Figure 2:
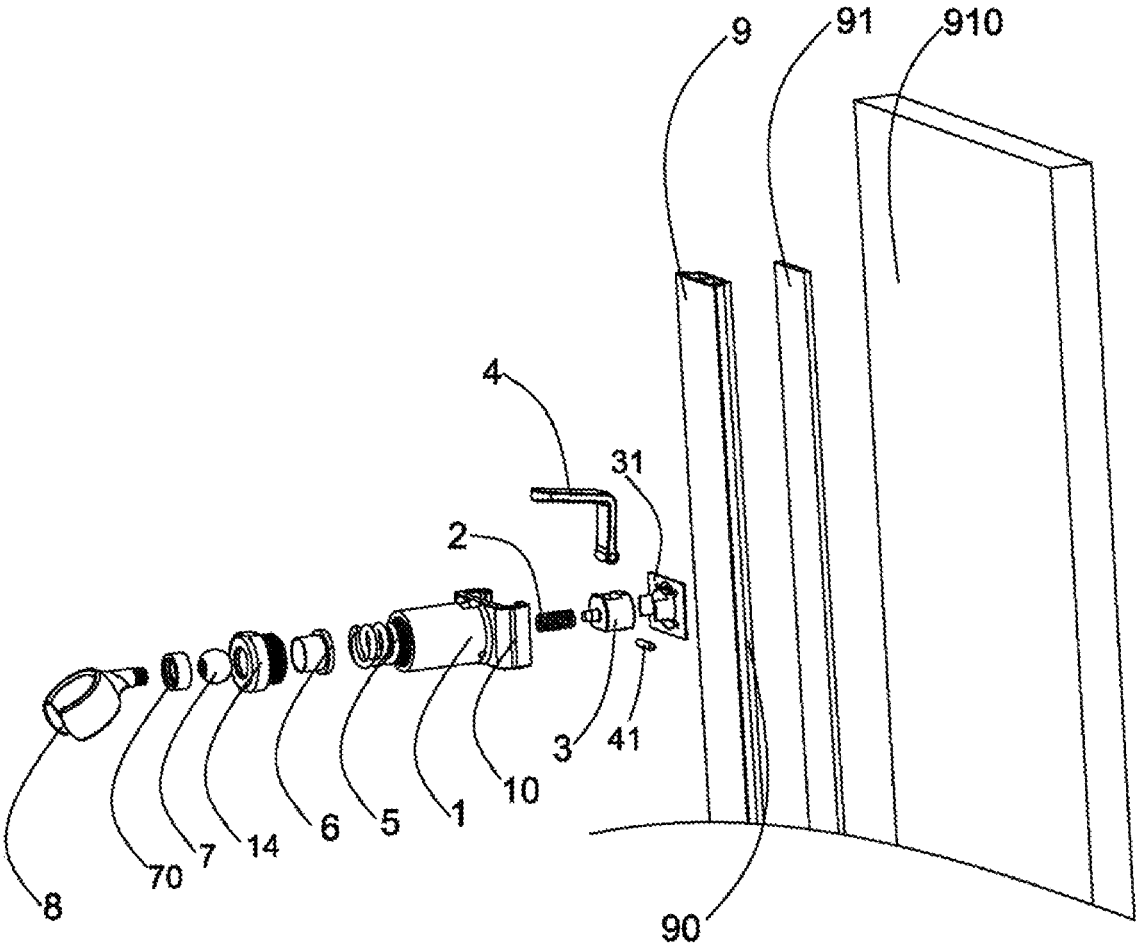
FIG. 2 is an exploded view of the hanging connection frame in embodiment I of the present application.

As shown in FIG. 2, the present embodiment provides a hanging connection sliding base, being sleeved over a rod body 9 to hang a shower head. The hanging connection sliding base comprises a sliding base body 1, a first elastic element 2, a packing block 3, a lever 4, a second elastic element 5, a ball cup 6, a ball 7, a ball pad 70 and a hanging base 8.

Figure 3:
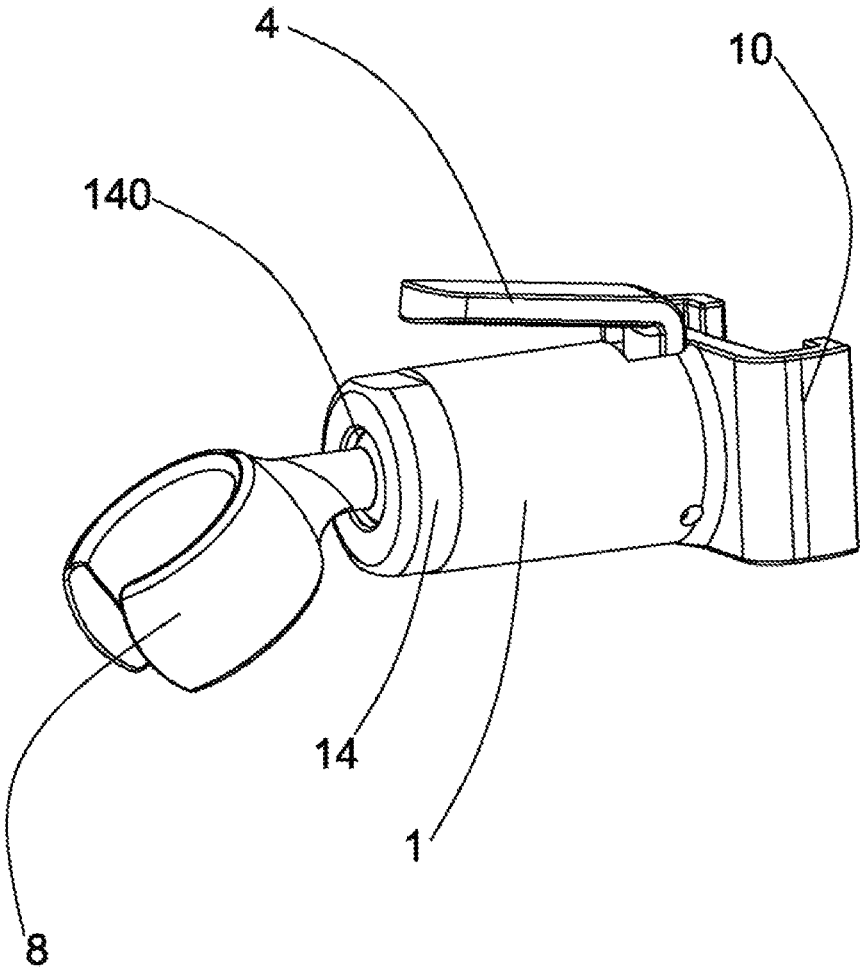
FIG. 3 is a three-dimensional view of a hanging connection sliding base in embodiment I of the present application.
Figure 4:
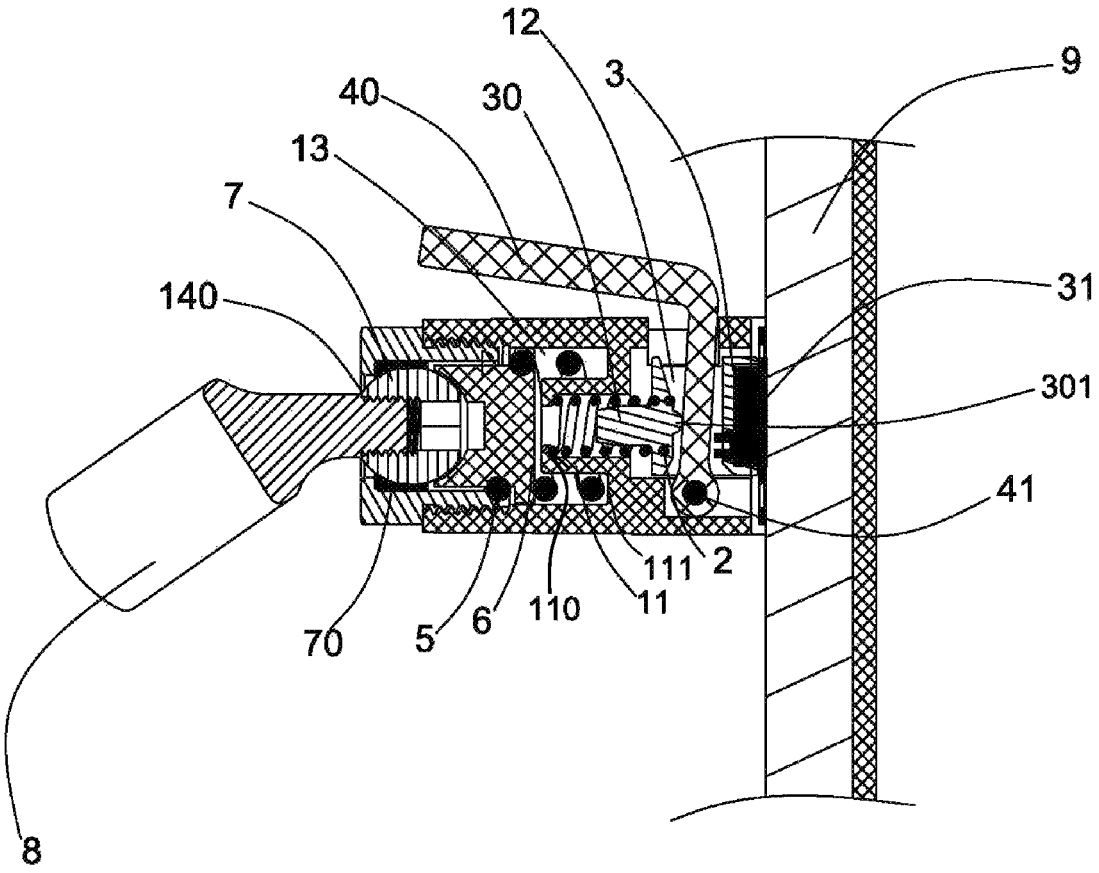
FIG. 4 is a cross-sectional view of the hanging connection sliding base in embodiment I of the present application.

As shown in FIG. 3 and FIG. 4, in the present embodiment I, the sliding base body 1 is provided with two oppositely arranged clamping jaws 10 and an inner cavity bottom wall 11. The two clamping jaws 10 are used for clamping the rod body 9 to form sliding connection. The inner cavity bottom wall 11 is arranged in the sliding base body 1, and the inner cavity bottom wall 11 is provided with a first ejecting retaining surface 110 and a second ejecting retaining surface 111, wherein the first ejecting retaining surfaces 110 faces the rod body 9, and the second ejecting retaining surface 111 is opposite to the rod body 9. The inner cavity bottom wall 11 and an inner wall of the sliding base body 1 are enclosed to define a packing block sliding cavity 12 and an inner cavity 13 on its two sides respectively. The packing block sliding cavity 12 is arranged on a side, close to the rod body 9, of the sliding base body 1, and is used for the packing block 3 to slide in a direction perpendicular to the rod body in the cavity; the inner cavity 13 is arranged on a side, away from the rod body 9, of the sliding base body 1, and is used for installing the hanging base 8 to hang the shower head. A leftmost end of the packing block sliding cavity 12 is the first ejecting retaining surface 110; a rightmost end of the inner cavity 13 is the second ejecting retaining surface 111.

As shown in FIG. 4, the packing block 3 is provided with a vertical through hole for the lever 4 to pass through, one surface, away from the rod body 9, of the through hole is a pushed portion 30 of the packing block, and one end, facing the rod body 9, of the packing block 3 is provided with a pressing element 31. One surface, facing the lever 4, of the pushed portion 30 is arranged as a bump 301 to be used for being in urging connection with the lever 4. In the present embodiment I, the bump 301 is an arc-shaped surface protruding towards the lever 4, and certainly other different bump types (such as a triangular bump) with achieving concentrated stress being a standard are also available. In the present embodiment I, the pressing element 31 is made of a soft rubber material.

In the present embodiment I, the first elastic element 2 and the second elastic element 5 are both springs, and certainly elastic elements in other types are also available.

Figure 1:
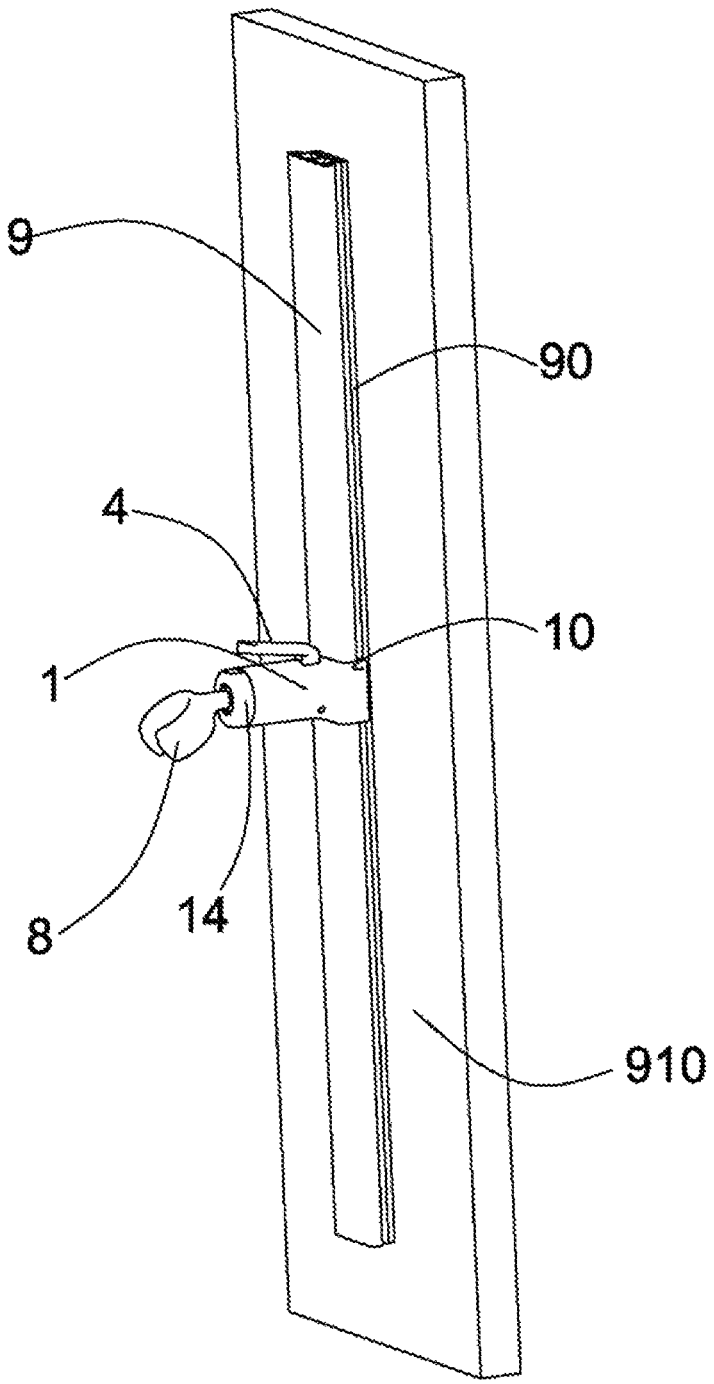
FIG. 1 is a using state view of a hanging connection frame in embodiment I of the present application.

As shown in FIG. 1, in the present embodiment I, the sliding base body 1 is connected to the rod body 9 in a sleeved manner through the clamping jaws 10, and the sliding base body 1 can slide up and down along the rod body 9 under effects of an external force, and can be fixed to any point on a sliding path.

Specifically, as shown in FIG. 4, on a side, close to the rod body 9, of the sliding base body 1, the first elastic element 2 and the packing block 3 are sequentially installed between the first ejecting retaining surface 110 and the rod body 9 from left to right (in a direction facing the rod body 9); one end of the first elastic element 2 presses and urges against the first ejecting retaining surface 110, and the other end of the first elastic element 2 presses and urges against the packing block 3; the packing block 3 is arranged on the sliding base body 1 in the direction perpendicular to the rod body 9 in a sliding manner.

The lever 4 penetrates through the vertical through hole of the packing block 3, and urges against the pushed portion 30 to form an urging connection point, and specifically, the lever 4 is in urging connection with the bump 301 on a right end face of the pushed portion 30. A bottom end of the lever 4 is hinged to the sliding base body 1 through a first pin shaft 41, and is used for positioning the lever 4; the lever 4 passes through a through hole in an upper portion of the packing block sliding cavity 12, and extends to an exterior of the sliding base body 1, so as to form an extending end 40 of the lever 4, and pulling operation by a bather is facilitated.

A screwing nut 14 is arranged on the side, away from the rod body 9, of the sliding base body 1, and is provided with a hanging base hole 140. The second elastic element 5, the ball cup 6 and the ball 7 are sequentially installed between the second ejecting retaining surface 111 and the hanging base hole 140 from right to left (in a direction backing onto the rod body 9). One end of the second elastic element 5 presses against the second ejecting retaining surface 111, and the other end of the second elastic element 5 urges against the ball cup 6, so that the ball 7 is clamped between the screwing nut 14 and the ball cup 6 due to an elastic effect by the ball cup 6. One end of the hanging base 8 runs through the hanging base hole 140 to stretch into the inner cavity 13 and be fixedly connected with the ball 7, and the other end of the hanging base 8 is arranged outside the sliding base body 1 and is used for hanging the shower head. The ball pad 70 is arranged between the ball 7 and an inner wall of the screwing nut 14 to play a buffering role. Due to arrangement of ball assemblies such as the ball cup and the ball, the hanging base 8 can achieve multi-angle direction adjusting due to rotation of the ball 7, a direction adjusting range of the hanging base 8 is increased, and thus practical use is more convenient.

Further, the present embodiment I further provides a hanging connection frame, comprising the above hanging connection sliding base and the rod body 9.

The rod body 9 is provided with sliding grooves 90 and a pasting plane 91. The sliding grooves 90 are formed at two sides of the rod body 9. As shown in FIG. 2, in the present embodiment I, the rod body 9 is arranged into a T-shaped structure so as to form the sliding grooves 90 at the two sides, and the sliding grooves 90 are used for the clamping jaws 10 to be clamped in. Further, the sliding rod 9 may also be arranged into other different structures such as a dovetail structure so long as the sliding grooves 90 can be formed at the two sides of the rod body 9. The pasting plane 91 is arranged on a side, facing a wall 910, of the rod body 9, the rod body 9 can be directly pasted on the wall 910 through the pasting plane 91, the overall installing space is substantially saved, and due to a pasting and fixed connecting manner, installing is easy, convenient and fast, and is not limited by an installing position or space.

After the rod body 9 is pasted to the wall 910, the hanging connection sliding base can slide into the sliding groove from any end of the rod body 9, so that the clamping jaw 10 arranged on the sliding base body 1 can be stably sleeved in the sliding groove 90; further, due to shape consistency of the clamping jaw 10 and the sliding groove 90, the hanging connection sliding base can be sleeved over the rod body 9 more firmly, and reliable using of the whole hanging connection frame is ensured.

Figure 6:
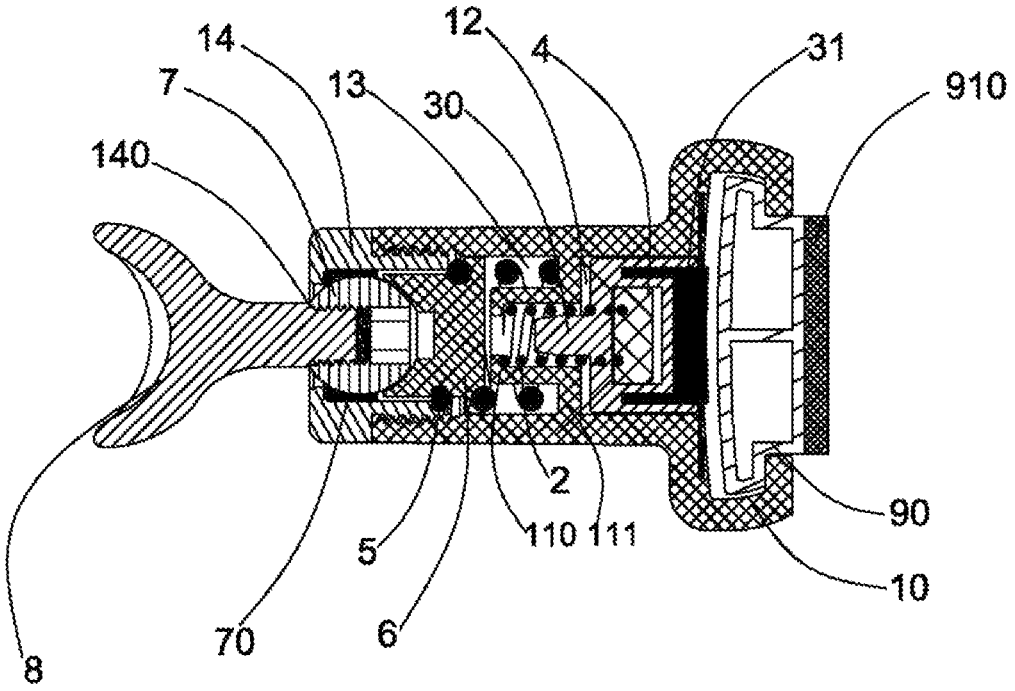
FIG. 6 is a structural view of an unlocked state of the hanging connection sliding base in embodiment I of the present application and the rod body.
Figure 7:
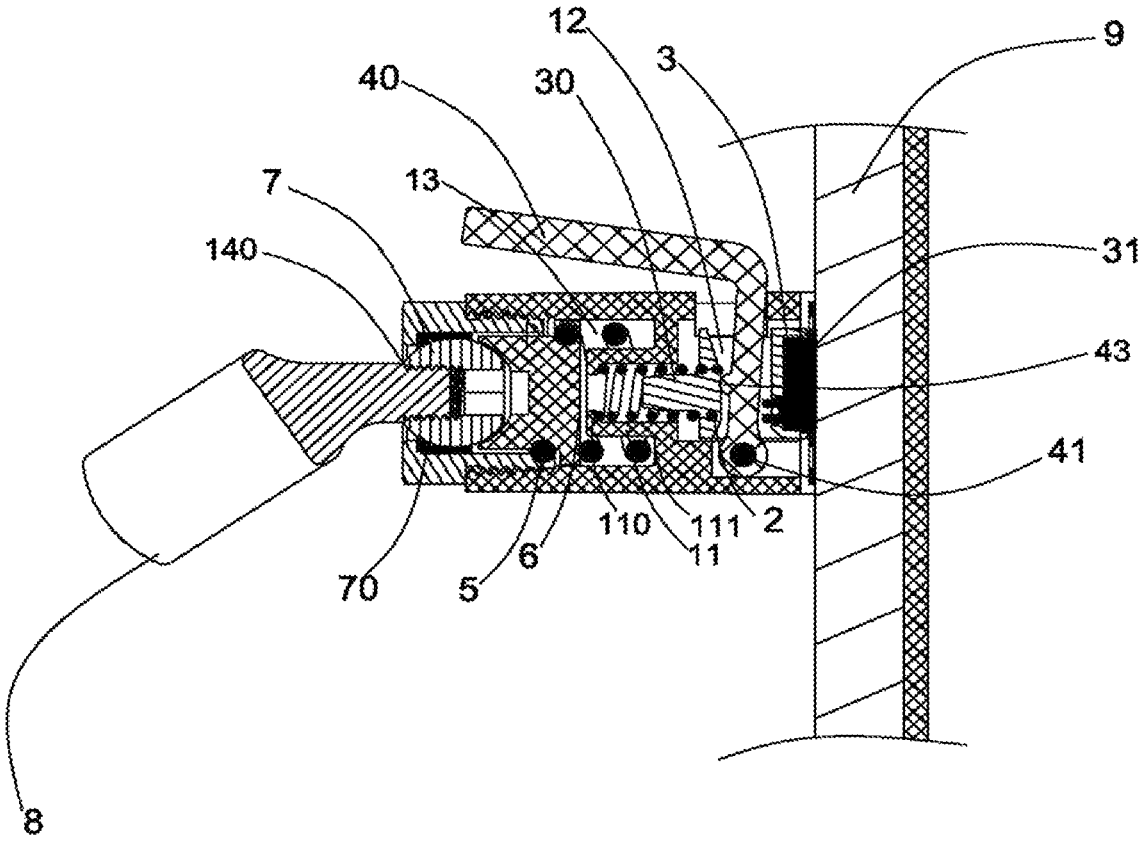
FIG. 7 is a structural view of a hanging connection sliding base in embodiment II of the present application.

As shown in FIG. 6, in the present embodiment I, when the bather leftwards pulls the extending end 40 of the lever 4, the lever 4 penetrating through the packing block 3 urges against the bump 301 arranged on the pushed portion 30 due to a lever effect, so that the packing block 3 is driven to slide in the direction away from the rod body 9 and presses the first elastic element 2, that is, the pressing element 31 is away from the rod body 9, so that a locked state of the hanging connection sliding base and the rod body 9 is unlocked. In the present embodiment I, a hinge joint of the lever 4 and the sliding base body 1 is a lever fulcrum, a lever power arm is between the extending end 40 of the lever 4 and the lever fulcrum, and a lever resistance arm is between the urging connection point formed by the lever 4 and the pushed portion 30 and the lever fulcrum. In the present embodiment I, the lever resistance arm and the lever power arm are located both on the same side of the lever fulcrum.

A driving manner of the lever is an implementation principle of a single lever and a single pendulum, and the pulling force needed is decreased by increasing the moment of force of the power arm, so that an objective of force-saving operation is achieved; different from a bilateral lever, too large space is not needed. In the present embodiment I, due to the fact that the contact surface of the lever 4 and the pushed portion 30 is arranged into the arc-shaped surface, the lever 4 after bearing force and being driven can directly presses and urges against the pushed portion 30 of the packing block 3 to apply force concentratedly, and therefore the packing block can be pushed more easily, and the pulling force needed by the lever is further decreased. Based on the above, operation for relieving fixation of the sliding base body 1 saves labor and is convenient, and fixation can be easily relieved.

Further, after the locked state of the sliding base body 1 and the rod body 9 is relieved, the lever 4 is kept in a pulling state (namely a state at which the packing block 3 keeps away from the rod body 9). Due to the fact that the lever 4 and the sliding base body 1 are of a hinged relationship, when a downward or upward vertical acting force is applied to the sliding base body 1 through the lever 4, the sliding base body 1 may be driven to move upwards or downwards along the rod body 9 to adjust a ground clearance of the sliding base body 1, so as to be applicable to people in different heights. In the above operation, the lever 4 can also apply a force to the sliding base body 1 in a vertical direction so that the sliding base body 1 can move up and down while the lever 4 applies a force (that is, the locked state of the sliding base body 1 and the rod body 9 is relieved) in a horizontal direction. Relieving the locked state of the above sliding base body 1 and operation of height adjusting can be completed at the same time with a single hand, and double-hand operation is not needed, which is quite essential for the bather, and is more convenient and practical. Moreover, the overall operation process is smooth, convenient and fast, and meanwhile a requirement of the bather for labor-saving operation is met. Further, due to the fact that the pressing element 31 is made of the soft rubber material, smooth and steady movement of the sliding base body 1 can be ensured, friction force generated between the sliding base body 1 and the rod body 9 in the moving process can be decreased, and abrasion caused to the rod body 9 is avoided; and smoothness and operating experience during moving of the sliding base body 1 can also be improved.

Figure 5:
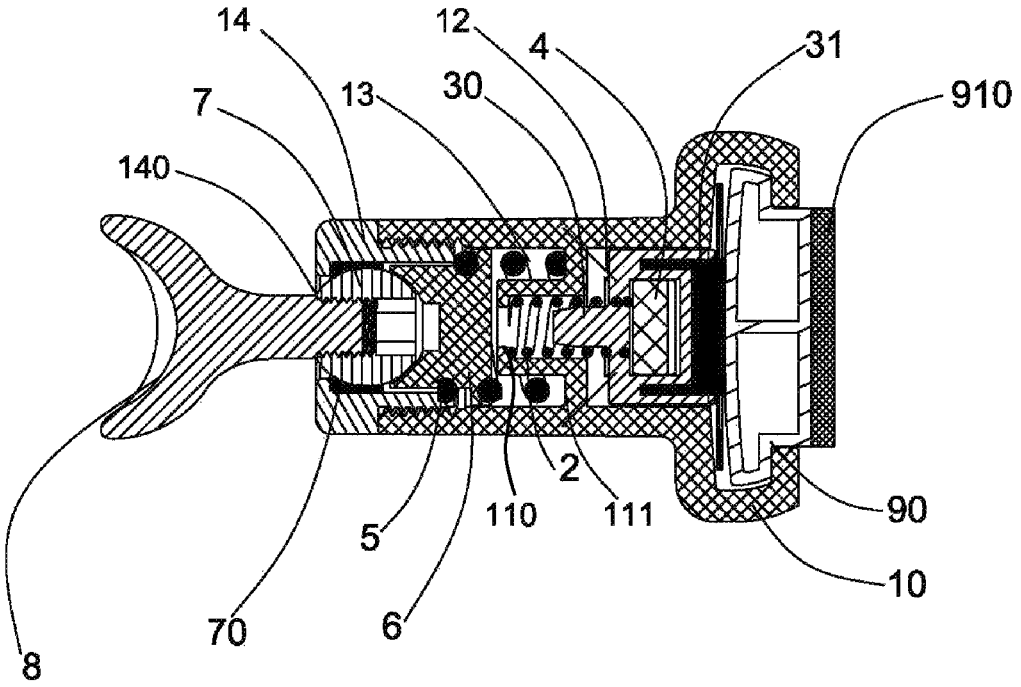
FIG. 5 is a structural view of a locked state of the hanging connection sliding base in embodiment I of the present application and a rod body.

As shown in FIG. 5, in the present embodiment I, after the extending end 40 of the lever 4 is released, the first elastic element 2 restores to its original shape, that is, the packing block 3 slides in the direction towards the rod body 9 under an elastic effect so that the hanging connection sliding base can be smoothly and steadily locked to the rod body 9. Further, after the sliding base body 1 is locked to the rod body 9, due to the fact that the pressing element 31 is made of the soft rubber material, the sliding base body 1 is not likely to slide again after fixation, and reliability of subsequent using is effectively ensured.

Embodiment II

The present invention further provides another embodiment II. In the present embodiment II, a hanging connection sliding base is provided, except that a lever 4 is provided with a lever bump 43, arrangement of a packing block 3 is different from embodiment I, remaining portions are all the same as embodiment I, and the descriptions thereof are omitted herein.

Embodiment III

The present invention further provides another embodiment III. In the present embodiment III, a hanging connection sliding base is provided, and except that a connection manner of a lever 4 and a packing block 3 is different from embodiment I, remaining portions are all the same as embodiment I, and the descriptions thereof are omitted herein.

Figure 8:
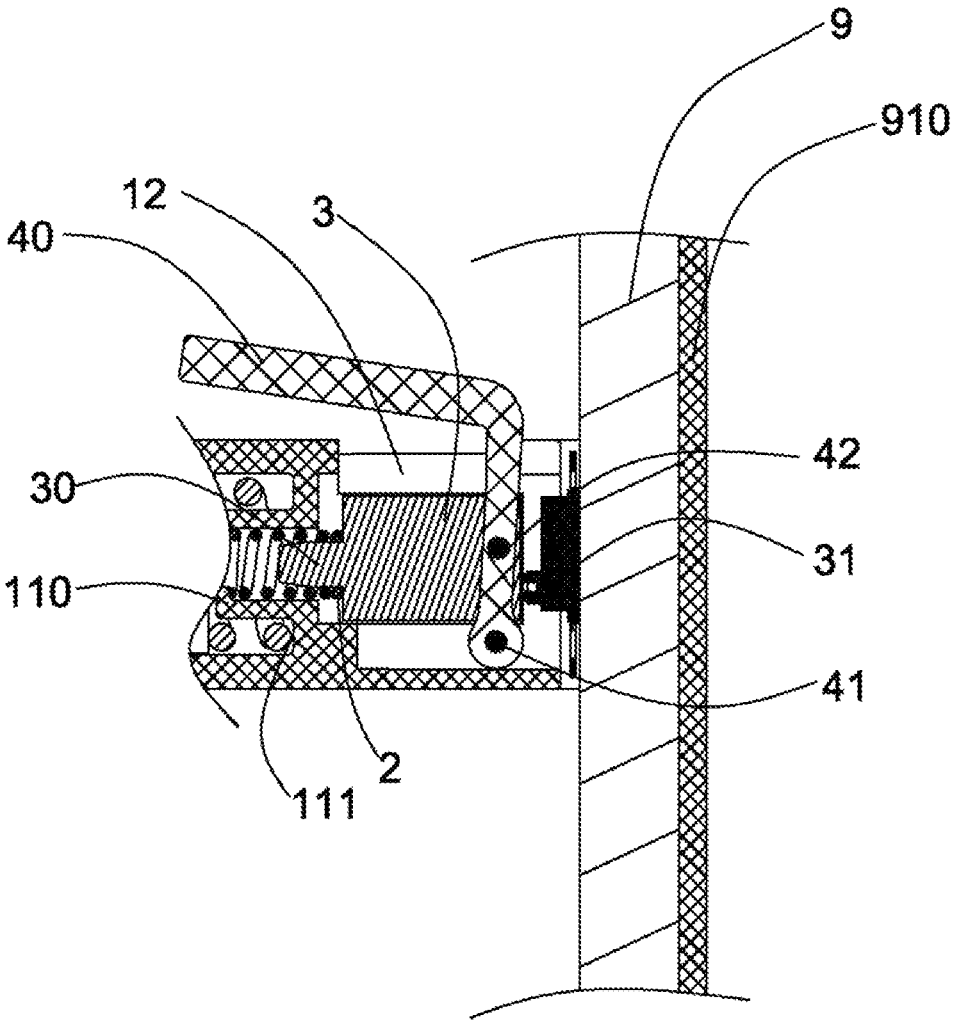
FIG. 8 is a local relationship schematic view of a hanging connection sliding base in embodiment III of the present application.

Referring to FIG. 8, FIG. 8 shows a local connection schematic view in the present embodiment III. As shown in FIG. 8, in the present embodiment, a bottom end of the lever 4 is hinged to a sliding base body 1 through a first pin shaft 41 as well to form a lever fulcrum (namely a position where the first pin shaft 41 is located), and a middle portion of the lever 4 is hinged to an outer side of the packing block 3 through a second pin shaft 42 to form a hinge joint (namely a position where the second pin shaft 42 is located); and the lever 4 extends outwards from an interior of a packing block sliding cavity 12 to an exterior of the sliding base body 1 to form an extending end 40. A lever resistance arm is formed between a hinge joint formed by the lever 4 and the packing block 3 and the lever fulcrum, and a lever power arm is formed between the extending end 40 of the lever 4 and the lever fulcrum; and the lever resistance arm and the lever power arm are located on the same side of the lever fulcrum.

In the present embodiment III, when the bather leftwards pulls the extending end 40 of the lever 4, that is, the lever power arm of the lever 4 is pulled, the lever 4 drives the packing block 3 to slide leftwards (namely a direction away from the rod body 9) as well, and therefore the packing block 3 presses a first elastic element 2, and a pressing element 31 detaches from the rod body 9, so that a locked state of the sliding base body 1 and the rod body 9 is relieved. Due to the fact that the lever resistance arm and the lever power arm are located on the same side of the lever fulcrum, a stress direction of the packing block 3 is the same as that of the lever 4, and thus when the lever 4 is pulled leftwards, the packing block 3 can be driven to slide leftwards. A driving manner of the lever is also an implementation principle of a single lever and a single pendulum, a space needed for the lever is small, and actions are simple and effective; and by increasing the moment of force of the lever power arm, an objective of labor-saving operation is achieved.

Similarly, in embodiment III, after the extending end 40 of the lever 4 is released, the first elastic element 2 restores to its original shape, that is, the packing block 3 slides in the direction towards the rod body 9 under an elastic effect, so that the hanging connection sliding base is smoothly and steadily locked to the rod body 9. Further, after the sliding base body 1 is locked to the rod body 9, due to the fact that the pressing element 31 is made of the soft rubber material, the sliding base body 1 is not likely to slide again after being locked, and reliability of subsequent using is effectively ensured.

Based on the above, in the above three embodiments, the hanging connection sliding base is provided, according to the hanging connection sliding base, relieving the locked state of the rod body 9 and the hanging connection sliding base and adjusting of the ground clearance of the hanging connection sliding base can be achieved just with a single hand, and the operation process saves labor and is simple; meanwhile the rod body 9 can be protected, and abrasion of the rod body 9 is avoided; further, a direction of the hanging base 8 can be adjusted at multiple angles. The related hanging connection frame is further provided, and the hanging connection frame is convenient and fast to install, reliable to use, capable of substantially reducing the overall installing space, and low in manufacturing cost.

What is claimed is:

1. A hanging connection sliding base, arranged on a rod body in a sliding manner for hanging objects, comprising:

a sliding base body, sleeved over the rod body, and provided with a first ejecting retaining surface facing the rod body;

a packing block, arranged between the first ejecting retaining surface and the rod body, and arranged on the sliding base body in a sliding manner in a direction perpendicular to the rod body;

a lever, hinged to the sliding base body, and movably connected with the packing block; and a first elastic element, arranged between the first ejecting retaining surface and the packing block, wherein the packing block is driven to be away from the rod body when the lever is pulled; the first elastic element drives the packing block to urge against the rod body when the lever is released; the sliding base body is provided with an inner cavity away from the rod body, an end, close to the rod body, of the inner cavity is provided with a second ejecting retaining surface; the hanging connection sliding base further comprises a second elastic element; and one end of the second elastic element presses against the second ejecting retaining surface.

2. The hanging connection sliding base according to claim 1, wherein the lever penetrates through the packing block, and one end of the lever stretches out of the sliding base body; the lever drives the packing block to slide in a direction away from the rod body by pulling the end of the lever stretching out of the sliding base body.

3. The hanging connection sliding base according to claim 2, wherein a bump is arranged on a surface of the packing block, wherein the surface is in contact with the lever.

4. The hanging connection sliding base according to claim 1, wherein the lever is hinged to the packing block, and one end of the lever stretches out of the sliding base body; the lever drives the packing block to slide in a direction away from the rod body by pulling the end of the lever stretching out of the sliding base body.

5. The hanging connection sliding base according to claim 1, wherein a pressing element is provided on an end, facing the rod body, of the packing block.

6. The hanging connection sliding base according to claim 1, wherein the other end of the inner cavity is provided with a hanging base hole; the second elastic element, a ball cup and a ball are sequentially installed in the cavity from the second ejecting retaining surface to the hanging base hole; and a hanging base runs through the hanging base hole and is fixedly connected with the ball.

7. A hanging connection frame, comprising a hanging connection sliding base and a rod body, wherein the hanging connection sliding base comprises:

a sliding base body, sleeved over the rod body, and provided with a first ejecting retaining surface facing the rod body;

a packing block, arranged between the first ejecting retaining surface and the rod body, and arranged on the sliding base body in a sliding manner in a direction perpendicular to the rod body;

a lever, hinged to the sliding base body, and movably connected with the packing block; and a first elastic element, arranged between the first ejecting retaining surface and the packing block, wherein the packing block is driven to be away from the rod body when the lever is pulled; and the first elastic element drives the packing block to urge against the rod body when the lever is released; and two sides of the rod body are provided with sliding grooves, and the hanging connection sliding base is sleeved in the sliding grooves, so that the hanging connection sliding base slides along the rod body.

8. The hanging connection frame according to claim 7, wherein two sides of the sliding base body of the hanging connection sliding base are provided with clamping jaws matched with the sliding grooves in shape, and the sliding base body is sleeved over the rod body due to an urging connection of the clamping jaws and the sliding grooves.

9. The hanging connection frame according to claim 8, wherein one side, facing a wall surface, of the rod body is provided with a pasting plane, and the rod body is pasted to the wall surface through the pasting plane.

* * * * *